United States Patent [19]

Aichinger

[11] 3,987,921

[45] Oct. 26, 1976

[54] CLOSURE FOR CONTAINERS

[75] Inventor: Dietmar Aichinger, Arlesheim, Switzerland

[73] Assignee: Albert Obrist AG, Reinach, Switzerland

[22] Filed: Apr. 8, 1975

[21] Appl. No.: 566,097

[30] Foreign Application Priority Data

Nov. 4, 1974 Switzerland ..... 15007/74
Mar. 18, 1975 Switzerland ..... 3541/75

[52] U.S. Cl. ..... 215/307; 215/329
[51] Int. Cl.[2] ..... B65D 51/16
[58] Field of Search ..... 215/216, 329, 330, 339, 215/340, 331, 307; 220/290

[56] References Cited

UNITED STATES PATENTS

| | | | |
|---|---|---|---|
| 1,549,910 | 8/1925 | Cramer | 215/330 |
| 2,162,880 | 6/1939 | Brown | 215/330 |
| 3,147,876 | 9/1964 | Lepore | 215/329 X |
| 3,405,831 | 10/1968 | Hudson | 215/330 |
| 3,435,978 | 4/1969 | Wittwer | 215/330 X |
| 3,682,345 | 8/1972 | Baugh | 215/330 |

*Primary Examiner*—Donald F. Norton
*Attorney, Agent, or Firm*—Larson, Taylor & Hinds

[57] ABSTRACT

A twist closure or screw-type cap is disclosed. The closure which has internal threading is for fitting onto a container having external threading. In one embodiment the uppermost thread turn of the internal threading of the cap terminates a distance spaced from the crown plate of the cap. In a further embodiment the cap is provided with a stopper which projects into and seals the opening of a container when the closure is positioned on the container, and characterized in that at least one beadlike enlargement is provided on the threading of the cap and/or container in the region of the beginning of thread commencement.

10 Claims, 9 Drawing Figures

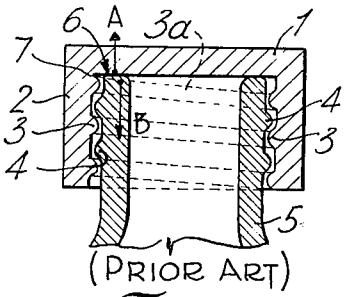
(PRIOR ART)
Fig. 1.
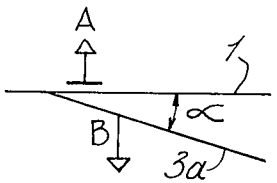
Fig. 2.
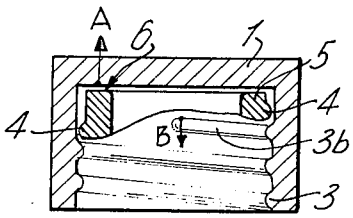
Fig. 3.
Fig. 4.
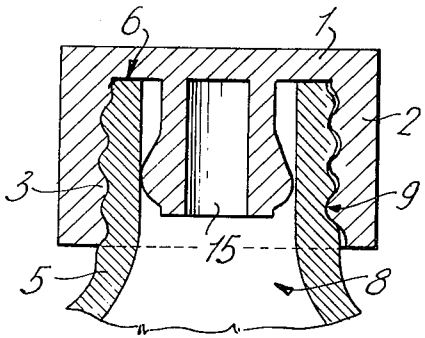
Fig. 5.
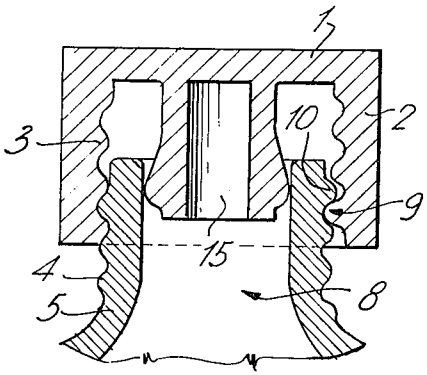
Fig. 6.
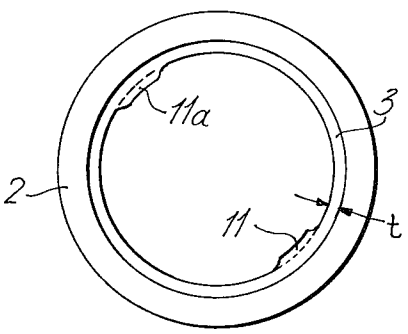
Fig. 7.
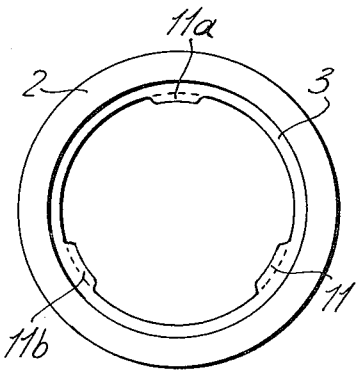
Fig. 8.
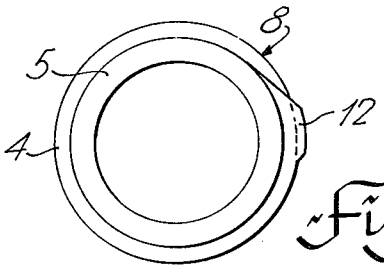
Fig. 9.

CLOSURE FOR CONTAINERS

One embodiment of closure cap disclosed herein, but not claimed, relates to a twist closure or screw-type cap having internal threading and a central seal or stopper protruding downwardly from the crown plate for sealing insertion into an open end of an externally threaded container. The closure is particularly well suited for use with containers or bottles containing liquid under some pressure such as carbonated beverages.

Many twist closures of this general type are known and used especially for closing bottles.

In the known variations, the screw cap, the crown plate and the internal threading are deep-drawn or pressed in one piece from metal, and more recently, are also produced from synthetic plastic material by injection-molding methods also in one piece.

Particularly in the case of synthetic plastic closures, in practical use difficulties appear frequently due to the fact that in the mechanical twisting and tightening of the closure the torque exceeds permissible maximums and the crown plate is broken away from the cylindrical part of the screw cap.

Since for satisfactory seating, and in the case of differing closure types, also for satisfactory sealing, it is essential that the twist closure be applied with a specific torque force which approaches maximum torque where the cap distorts or fractures, extraordinarily high demands are placed on existing automated bottling and capping machinery, and the twist closures presently available cannot reliably be used.

The present invention avoids the disadvantages of the prior art by providing a twist closure which can be screwed on with great tolerances in degree of torque without danger of destruction.

According to this embodiment of the invention this is achieved in an optimally simple manner in that the uppermost thread turn of the internal threading of the cap terminates a distance from the crown plate. It has been determined that the main cause for the above-described destruction of known twist closures by breaking away of the crown plate is due to the transition of the last thread turn into the crown plate as in the most unfavourable manner the force on the one hand which is taken up by the thread turn and the force on the other hand acting in the opposite direction upon the crown plate act at an acute angle. The destruction of the twist closure or the breaking away of the crown in known twist closures is also regularly observed to be at the point where the last thread turn either terminates directly in the crown plate or ends directly beside the crown plate.

Twist closures having a central protruding stopper or seal are generally known and used especially in the case of bottles for beverages containing carbon dioxide. The seal part protruding into the container opening and abutting on the inner opening wall is essential for satisfactory sealing especially for the reclosing of opened bottles, this seal part ensuring the sealing of the bottle usually after only a quarter turn or half turn of the screw cap.

Difficulties arise with known twist closures due to the fact that during opening of the bottle the seal is maintained in the described manner until the thread engages with only a part of the last turn. Particularly in the case of beverages or liquids under relatively high pressure during opening of known twist closures the screw cap is suddenly exploded or blown away from the container opening in the last phase of opening when the remainder of the threading which is in engagement is no longer capable of holding the cap. This danger is also increased by the fact that the tolerances of screw caps which are injection-molded for example from synthetic plastics material are relatively large for reasons of production. In synthetic plastic screw caps, tolerance differences result particularly from different shrinkage characteristics of the plastic materials after removal from the mold, the tolerance of the injection molds themselves and also the relatively large tolerances in the external threadings of beverage bottles.

A simple reduction of the internal diameter of the screw caps is not the answer and would lead for example to the result that in the case of an unsuitable combination of tolerances the screw caps would be seated so firmly on the external threading of the container that both closing and opening would require unreasonably high forces.

One purpose of the present invention is to avoid these disadvantages of the prior art, and to provide a twist closure which on the one hand avoids any sudden bursting away of the screw cap when the last thread turn is reached, and which on the other hand can be fitted to and detached from a bottle manually with reasonable ease.

According to this aspect of the invention, this is basically achieved in that the internal threading of the screw cap and/or the external threading of the container has at least one protrusion enlarging the thread turn in the region of thread commencement.

The provision of the enlarging protrusion on at least one turn of the inner and/or outer threading satisfies the requirement that the screw cap engages firmly during the last turn in the threading and becomes free only after complete opening. Thus the stopper seal part also comes out of engagement with the container opening so that the gas pressure in the container can substantially diminish before the screw cap is mechanically free from the container neck.

As will be seen by appropriate dimensioning of the enlargement it is also possible to compensate for additional tolerance differences resulting from the inherent elasticity of synthetic plastic closures.

It has been found however that the force necessary for closing and opening is kept within acceptable limits if the teaching of the present specification are followed.

For the closure of mass produced glass bottles with external screw threading it has proved advantageous to provide the enlargement at the thread commencement of the internal threading of the screw cap. It is also particularly advantageous if two reinforcements are provided lying opposite to one another at an interval of about 180° around the thread turn.

In the case of synthetic plastic closures of relatively elastic material it has proved advantageous to provide three enlargements at an interval of about 120° around the first thread turn.

Reliable seating of the closure during the last phase of the opening operation is guaranteed especially if the enlargement on the thread turn amounts to about one-third to two-thirds of the thread depth, provided that two or three enlargements are provided. In the case of two mutually opposite enlargements best results can be obtained if the extent or elevation in each case amounts to about one-half of the thread depth.

In the case of only one enlargement the extent of such should amount to about three-quarters to one and one-quarter of the thread depth.

The invention will now be more fully described with reference to the accompanying non-limiting drawings wherein:

FIG. 1 is a side sectional view of a twist closure according to the prior art;

FIG. 2 is a diagrammatic representation of the forces resulting from a fastening of the twist closure according to FIG. 1;

FIG. 3 is a side sectional view of a twist closure according to one embodiment which is not claimed herein;

FIG. 4 is a diagrammatic representation of the forces encountered during fastening of the twist closure cap as shown in FIG. 3;

FIG. 5 shows in side sectional view a twist closure in accordance with the present invention positioned in closed position on a container;

FIG. 6 is a similar showing to FIG. 5 but showing the closure in almost open position;

FIG. 7 is a sectional plan view of a twist closure according to a further embodiment showing the presence of two enlargements;

FIG. 8 is a sectional plan view of a further embodiment of a twist closure showing three enlargements; and FIG. 9 is a top plan view of a container showing the provision of an enlargement on the thread thereof.

The twist closures as shown in FIG. 1 and FIG. 3 comprise a crown plate 1 and a cylindrical screw cap 2 having internal threading 3. The internal threading 3 is adapted for threading engagement with external threading 4 provided on the outside of a container neck 5.

As will be seen in FIG. 1 in the fully tightened condition the crown plate 1 bears on the upper edge 6 of the container neck 5. The resultant force acting upon the crown plate 1 is shown by arrow A. The resultant force acting upon the last thread turn 3*a* of the internal threading 3 due to the engagement of the external threading 4 with the internal threading 3 is designated by arrow B. As illustrated particularly well in FIG. 2, the two forces A and B act at the acute angle $\alpha$, since the force B is introduced from the last thread turn 3*a* obliquely into the crown plate 1. Thus particularly at the transition point 7 between the last thread turn 3*a* and the crown plate 1, extraordinarily high forces occur which in the case of an excessive tightening of the twist closure will lead to deformation or destruction or breaking away of the crown plate 1.

FIG. 3 shows in comparable representation a screw cap 2 of an embodiment wherein the last thread turn 3*b* of the internal threading 3 terminates a distance from the crown plate 1.

As will be appreciated from FIG. 4, due to the configuration in accordance with this embodiment the force B is conducted at a distance from the crown plate 1 uniformly into the wall 2 of the screw cap. Since the force A and the force B lie exactly opposite to one another and moreover are flatly distributed in the screw cap wall 2 above the thread turn 3*b*, even with the occurrence of high torque in mechanical application possible destruction and deformation of the cap is minimized.

The drawings are, of course, generalizations only and particularly do not show the spread of forces over the entire internal threading 3. This, however, is of secondary importance in the present considerations since according to experience it is only and exclusively the forces directly acting at the termination of the last thread turn 3*a*, 3*b* which lead to destruction as discussed.

The expedient vertical distance between the end of the last thread turn 3*b* and the crown plate 1 can be determined according to the particular formation of the threading and/or the material used in any individual case. It is also possible and at times advantageous if the last thread turn 3*b* merges in rounded form (FIG. 3) into the screw cap wall 2 as this results in improved force distribution.

According to FIGS. 5 and 6 the twist closure 2 of this embodiment of the invention has in the region of the container opening 8 an external threading 4 which is closed by the screw cap which has internal threading 3.

As illustrated, a stopper or seal part 15 protrudes into the container opening 8 and seals off the container after rotation of the screw cap 2 through only about one-quarter rotation (FIG. 2). In order to prevent the screw cap from being blown or exploded away from the container upon opening of the container due to the fact that the last thread turn 9 of the cap 2 is pressed over the last thread turn 10 of the container opening 1, the last thread turn 9 of the cap is enlarged or elevated as by means for example, of a bead-like reinforcement 11.

As a result, on opening of screw cap 2 the latter is held fast on the container 1 until the stopper part 15 clears the container opening 8 and the internal pressure in the container can diminish before the cap 2 is completely free from the container opening 1. The length of the bread-like enlargement 9 may here be seen from the illustration in FIG. 7, with a second reinforcement 11*a* being provided in order to hold the cap 2 on the container on both sides.

As may be seen from FIG. 7 the enlargements 11 and 12 are in each case about half as high as the thread depth *t*.

FIG. 8 shows the cap 2 with three reinforcements 11, 112 and 11*b* on the last thread turn, which ensure reliable anchoring during the last phase of the opening action, especially when the cap is made of elastic material.

FIG. 9 shows a plan view of a container opening 8 wherein the external threading 4 is provided with a bead-like enlargement 12 at the beginning of the threading.

As in the case of the other examples, this reinforcement 12 ensures firm seating of the internal threading 3 of the cap on the external threading 4 of the container during the last turning of the opening action.

In terms of production and use it is simpler to provide the bead-like enlargement of the inner and/or outer thread in each case directly on the thread turn in the above-described manner. However, in specific cases it is of course also possible to position the bead separately, for example, as an extension of the thread turn or somewhat beneath the last thread turn.

I claim:

1. In combination, a pressurized container having an externally threaded container neck opening, and a screw cap positioned thereon, said screw cap having internal threading and a stopper projecting into and sealing the opening, characterized in that at least one radial enlargement is provided on the internal surface of said cap in the region of the beginning of the thread commencement adjacent the open end of the cap so as to ensure firm engagement of the cap threading with the opposing container threading until after said stopper unseals said opening and releases the container pressure during removal of the cap, said radial enlargement projecting radially inwardly beyond the radially inner surface of said cap thread by a radial distance less than the circumferential extent of said enlargement, and being located and arranged to prevent blow-off of said cap during the latter stage of removal and attendant decreased thread engagement.

2. The combination according to claim 1 wherein said cap includes two radial enlargements lying opposite to each other.

3. The combination according to claim 1 wherein three radial enlargements are provided in the cap at spaced distances of 120°.

4. The combination according to claim 1 wherein said radial distance is between about one-third and two-thirds of the radial thread depth in the cap.

5. The combination according to claim 4 wherein said radial distance is about one-half of the radial thread depth of the cap thread.

6. The combination according to claim 1, having a single radial enlargement, and wherein said radial distance is between three-quarters to one and one-quarter of the radial thread depth of the cap thread.

7. The combination according to claim 1 wherein said radial enlargement is formed on the first thread turn of said cap considered from its open end.

8. A screw-type cap for externally threaded pressurized containers comprising an integral crown plate and generally cylindrical internally threaded portion of plastic material, a stopper member projecting from said crown plate into said cylindrical portion and radially spaced from said cylindrical portion so as to extend into and seal the neck opening of a container on which the cap may be screw-mounted, said stopper member being devoid of openings or passages which would permit pressure release from a container on which the cap is screw-mounted to a predetermined extent, at least one radial enlargement projecting radially inwardly from said cylindrical portion in the region of the open end of the cylindrical portion and beyond the radially inner surface of said cap thread, said radial enlargement being constructed and arranged to bear against a container on which the cap may be screw-mounted to ensure firm engagement of the cap until the stopper member unseals the container during removal of the cap, whereby to prevent blow-off of said cap during the latter stage of removal from a container.

9. A screw-type cap according to claim 8 wherein said radial enlargement is positioned so as to be at least in alignment with the spiral path of said thread.

10. A screw-type cap according to claim 9 wherein said radial enlargement is disposed on the radially innermost thread surface and projects inwardly therefrom.

* * * * *